US005378063A

United States Patent [19]

Tsukada

[11] Patent Number: 5,378,063

[45] Date of Patent: Jan. 3, 1995

[54] STATIC MIXING MODULE

[75] Inventor: Ken Tsukada, Tokyo, Japan

[73] Assignee: Tokyo Nisshin Jabara Co., Ltd., Tokyo, Japan

[21] Appl. No.: 160,252

[22] Filed: Dec. 2, 1993

[51] Int. Cl.[6] ..... B01F 5/06

[52] U.S. Cl. ..... 366/337; 366/340

[58] Field of Search ..... 366/336, 337, 338, 339, 366/340; 138/37, 42

[56] References Cited

U.S. PATENT DOCUMENTS

| | | | |
|---|---|---|---|
| 3,406,947 | 10/1968 | Harder | 366/337 |
| 3,923,288 | 12/1975 | King | 366/336 |
| 4,034,965 | 7/1977 | King | 366/336 |
| 4,220,416 | 9/1980 | Brauner | 366/337 |
| 4,744,918 | 5/1988 | Meier | 366/337 |

*Primary Examiner*—Robert W. Jenkins
*Attorney, Agent, or Firm*—Rogers & Killeen

[57] ABSTRACT

A static mixing module in which mixing parts having a relatively short length are assembled such that grids are formed with central strip portions and wing portions of the mixing parts or with the central strip portions, wing portions and tail portions of the mixing parts. Further, cut-off portions are formed between adjacent two wing portions. This configuration forms complex fluid passages. Each mixing part can be formed by a simple punching step and a bending step, each at least once, and a static mixing module can be manufactured by simply assembling these mixing parts. Therefore, the mixing module has a higher mixing/blending performance event though it has a length similar to conventional modules or packets, and has a reduced pressure loss. Further, since it can be cheaply manufactured compared to the conventional products, it is advantageous in terms of production costs and production efficiency.

14 Claims, 7 Drawing Sheets

STATIC MIXING MODULE

BACKGROUND OF THE INVENTION

1. Field of the Invention

The present invention relates to a static mixing module in which at least two mixing parts having the same configuration are assembled and disposed in a static state inside a piping for blending or mixing at least two kinds of fluids, and in particular to a static mixing module which can be easily formed and assembled, can be manufactured at a low cost.

2. Disclosure of the Related Art

From the viewpoint of economy and mixing/blending efficiency, static mixing modules having a high mixing/blending efficiency relative to their lengths and reduced pressure loss are desired.

Conventionally, to satisfy this requirements, a module disclosed in FIG. 1 of Japanese Patent Application Laid-open (Kokai) No. 56-62531 and a packet disclosed in FIG. 3 of Japanese Patent Publication (Kokoku) No. 61-32117 have been proposed. These module and packet basically have a configuration shown in FIG. 10 (Prior Art).

When a static mixing module having a configuration shown in FIG. 10 (Prior Art) is manufactured by a conventional manner, plural kinds of pieces having predetermined shapes are firstly formed by press working, as shown in FIGS. 11A, 12A and 13A (Prior Art), and the pieces are then assembled and welded to form blocks, as shown in FIGS. 11B, 12B and 13B (Prior Art). Subsequently, these blocks are assembled to obtain a module having the configuration shown in FIG. 10 (Prior Art).

The above-described process of forming separate pieces has the drawback that it involves cumbersome steps of making blocks and welding. In order to solve this drawback, the following improvement has been proposed. Namely, as shown in FIG. 14, a plate 50 (blank) is cut at lines 51 by press-cutting leaving center portions 52 for twisting (hereinafter referred to as twist portions 52) and holes 53, 53 are made as facing each other with a twist portions 52 between. After the press working, the plate 50 is subjected to bending or twisting to form a block as shown in FIG. 15 (Prior Art). After preparing one more block having the configuration shown in FIG. 15 (Prior Art), the block is divided into two pieces to obtain blocks which have configurations as shown in FIG. 16A (Prior Art) and FIG. 16B (Prior Art), respectively. These blocks are assembled to obtain a static mixing module having the configuration shown in FIG. 10 (Prior Art).

In the first method shown in FIGS. 11A, 11B (Prior Art) through FIGS. 13A, 13B (Prior Art), pieces can be formed by punching only, and the dies for punching are simple. Further, the accuracy of each piece can easily be secured. However, there is a disadvantage in that many and varied parts are required to conform the dimension of piping in which the static mixing module is placed. This causes a drawback that the selection of parts and management of supplementing the parts become difficult, resulting in the rise of problems in quality control, involving the presence of foreign parts. Further, problems of production cost, production efficiency, and the like are also incurred.

Although the second method shown in FIG. 14 through FIG. 16 can remarkably reduce the number of steps for welding and assembling, the method requires a variety of press workings, such as hole-forming, cutting, primary bending, twisting, cutting-off, and the like. Therefore, a large number of dies are required in this method. This results in an increase in the production cost, and also deterioration in strength of the twisted portion. Moreover, there is a potential drawback that the chances of defects such as breakage, deformation and burrs increase. The conventional method therefore involves troublesome works.

SUMMARY OF THE INVENTION

An object of the present invention is to provide an improved static mixing module which has a high mixing/blending performance relative to its length, and which produces a reduced pressure loss compared to the conventional modules and packets.

In the present invention, this object is attained by assembling mixing parts having a relatively short length such that three-dimensional grids are formed with central strip portions and wing portions of the mixing parts, or with central strip portions, wing portions and tail portions of the mixing parts, and such that cut-off portions are formed between adjacent two wing portions so as to provide a complex fluid passages.

Another object of the present invention is to provide an improved static mixing module which can be manufactured very economically as compared to conventional products, and is superior to conventional products in terms of production cost and production efficiency.

In the present invention, plural mixing parts of a static mixing module can be formed by a simple punching step and a bending step, each at least once, and a static mixing module can be manufactured by simply assembling these mixing parts.

DETAILED DESCRIPTION OF THE PREFERRED EMBODIMENTS

A static mixing module according a first embodiment of the present which is suitable to be placed in a pipe having a relatively large diameter (inside diameter: about 50 to 200 mm) will firstly be explained with reference to the drawings.

Figure 1:
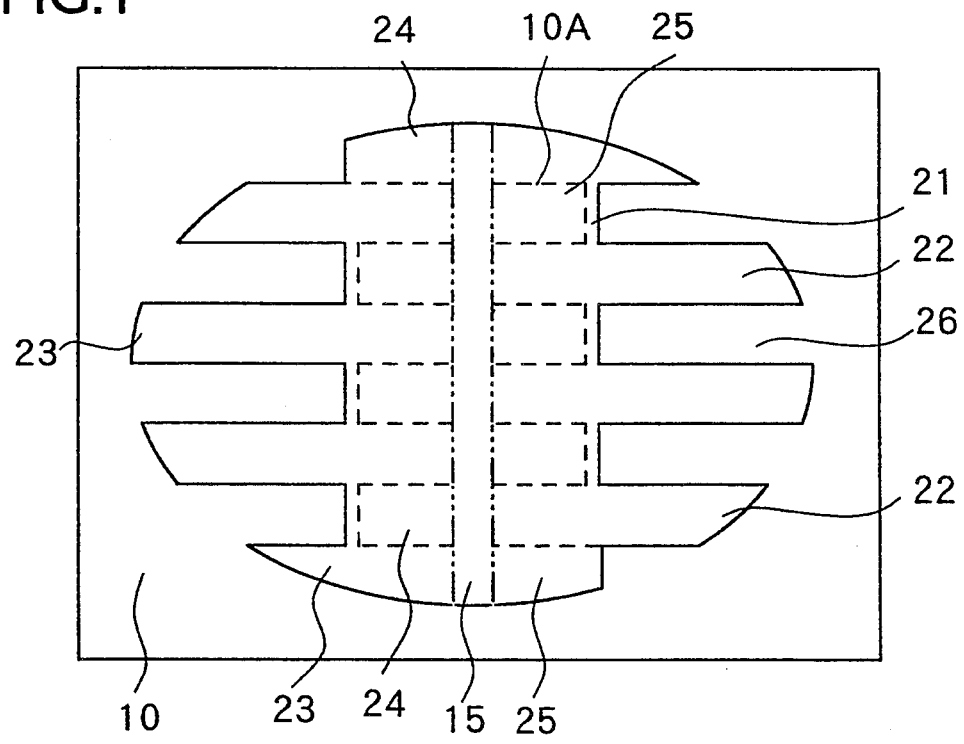
FIG. 1 is a plane view showing working lines for press and working lines for bending.

For manufacturing the static mixing module according to the first embodiment of the invention, a stainless steel plate 10 is first subjected to a press-working for being cut along the solid line on the stainless steel plate 10 shown in FIG. 1. Simultaneously with the above-described working, or prior to or after the above-described working, incisions are formed in the stainless steel plate 10 along broken lines 10A.

It is advantageous that punching is performed to made an elliptical hole in the stainless steel plate 10. The stainless steel plate 10 may firstly be punched into an elliptical shape, and cut-off portions 26 may be punched off from the elliptically shaped plate in a successive punching step. However, it is more advantageous to carry out the two punchings simultaneously to reduce the number of punching steps.

After the above-described punching, a central strip portion 15, wing portions 22, 23 and tail portions 24, 25 are left. The central strip portion 15 extends along the minor axis of the ellipse. The wing portions 22, 23 and tail portions 24, 25 respectively have predetermined widths and extend in a direction perpendicular to the central strip portion 15, namely, along the major axis of the ellipse.

Further, by the above-mentioned formation of the incisions, support portions 21 are defined at the outer ends of the tail portions 24, 25. The support portions 21 may or may not be formed at the outer ends of the tail portions 24, 25 which are located at both outer ends in the direction of minor axis of the ellipse. In this embodiment, the support portions 21 are not defined at the outer ends of these tail portions.

At the outer sides of the tail portions 24, 25 or the support portions 21, the cut-off portions 26 are formed by the above-described punching working.

The wing portions 22 and the tail portions 25, or the wing portions 23 and the tail portions 24 are respectively arranged on both sides of the central strip portion 15 such that the wing portions and tail portions are alternately arranged from the top as viewed in FIG. 1. Namely, on the right side of the central strip portion 15 as viewed in the drawing, the wing portions 22 and the tail portions 25 are alternately arranged from the top. On the left side of the central strip portion 15, the tail portions 24 and the wing portions 23 are alternately arranged from the top.

Although the lengths of the tail portions 24, 25 are not particularly limited, it is preferred that the lengths be from about half to one third of the lengths of the wing portions 22, 23 located at the opposite side of the central strip portion 15. This dimensional relationship is determined such that the tail portions 24, 25 define two sides of square grids of mixing parts.

Next, bending working is carried out. This bending working can be carried out simultaneously with the above-described punching.

Figure 2:
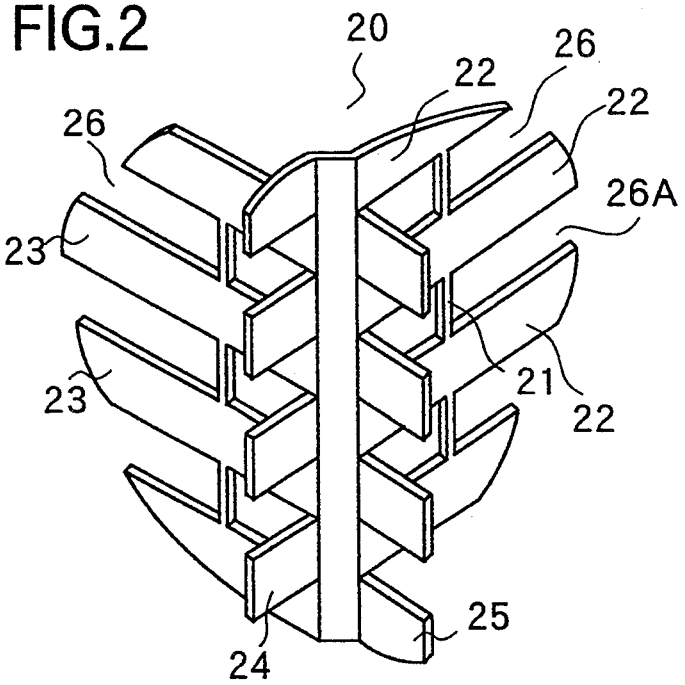
FIG. 2 is a perspective view of a mixing part.
Figure 3:
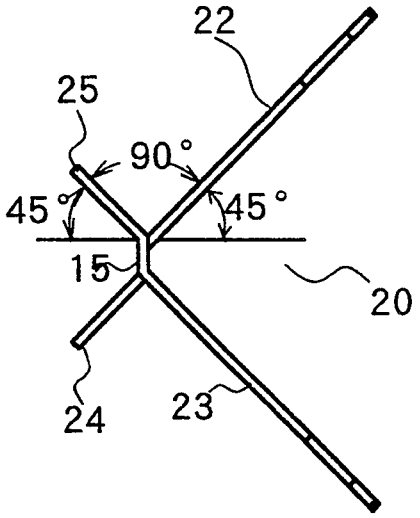
FIG. 3 is a side view of the mixing part.

In detail, bending is carrying out at working lines indicated by the two-dot chain lines defining both sides of the central strip portion 15, as shown in FIG. 1. Namely, the wing portions 22, 23 located on both sides of the central strip portion 15 are bent by an angle of about 45° with respect to the central strip portion 15 in the same direction, as shown in FIG. 2 and FIG. 3. Further, the tail portions 25, 24 located on both sides of the central strip portion 15 are bent by an angle of about 45° with respect to the central strip portion 15 in a direction opposite to the direction in which the wing portions 22, 23 are bent.

By the above-described bending, a mixing part 20 shown in FIGS. 2 and 3 is manufactured. In the mixing part 20, the angle between the wing portions 22 and the wing portions 23, the angle between the tail portion 24 and the tail portion 25, the angle between the wing portion 22 and the tail portion 25, and the angle between the wing portion 23 and the tail portion 24 all become about 90° (especially, see FIG. 3).

The support portions 21 defined in FIG. 1 are formed by the result of the above-described punching, incision-forming and bending. When the support portions 21 are formed such that each of the support portions 21 connects adjacent two of the wing portions 22 or adjacent two of the wing portion 23, the support portions 21 act as reinforcements. Further, the support portions 21 act as stoppers when the mixing part 20 is assembled. In a case in which the support portions 21 are not required to act as reinforcements, the support portions 21 may be omitted. In this case, convex portions are formed on the wing portions 22 in such a way that the convex portions act as stoppers.

Figure 4:
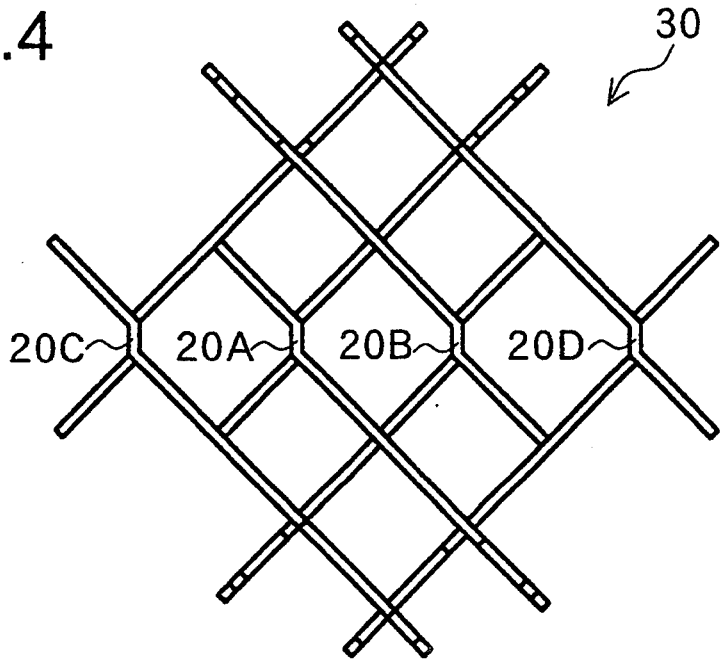
FIG. 4 is a side view of a static mixing module.

To manufacture a static mixing module 30 by using the mixing part 20 shown in FIG. 2 and FIG. 3, four mixing parts 20A, 20B, 20C and 20D are prepared. The pair of the mixing parts 20A and 20B are faced such that the bent directions of the mixing parts 20A and 20B become opposite, and are then engaged with each other such that the wing portions 22, 23 are inserted into the corresponding cut-off portions 26 (see FIG. 2), until the wing portions 22, 23 contact the support portions 21. Further, another pair of mixing parts 20C and 20D are assembled such that the wing portions 22, 23 of the pair of mixing parts 20C, 20D are inserted into the open ends 26A of the cut-out portions 26 formed between the wing portions 22, 23 of the pair of mixing parts 20A and 20B, whereby a plurality of grids are formed as shown in FIG. 4.

Namely, the mixing parts 20C, 20D are assembled to be located on both sides of the inner mixing parts 20A, 20B so that another pair of mixing parts 20C, 20D are formed. In other words, the mixing parts 20A and 20B form a mixing part group, the mixing parts 20A and 20D form another mixing part group at one outer side of the mixing part group of 20A and 20B, and the mixing parts 20B and 20C form still another mixing part group at the other outer side of the mixing part group of 20A and 20B.

Figure 5:
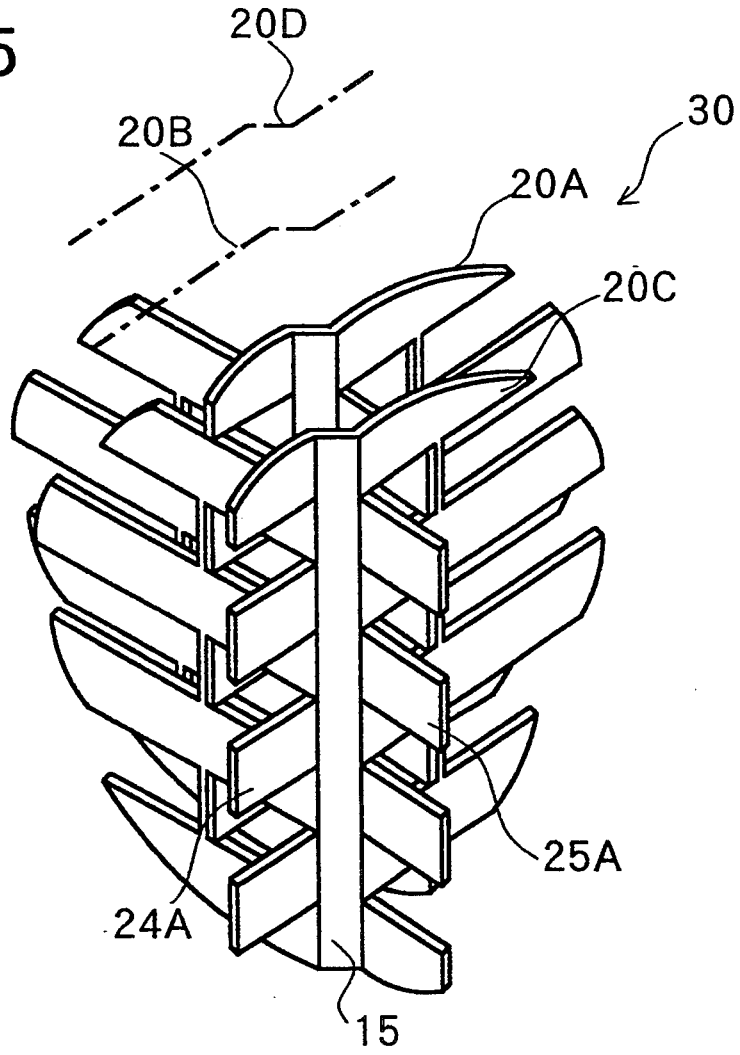
FIG. 5 is a perspective view of the static mixing module.

The mixing module 30 shown in FIG. 5 is obtained in the above-described manner. In FIG. 5, the mixing parts 20B and 20D are illustrated in a simplified manner.

In the above-described embodiment, it is preferred that the mixing parts be welded with one another at several portions. When the precision of press working is sufficiently high, the mixing parts are not required to be welded. In any case, the number of portions at which welding is carried out is reduced compared to the conventional manner in which all of contacting portions are welded.

The material of the static mixing module 30 is not limited to stainless steel, and other kind of materials such as metals, resins, or ceramics may be used.

Although the wing portions and tail portions have a flat shape having no holes, holes may be formed in these portions by punching for increasing the mixing/blending efficiency.

The stainless steel plate is punched into an ellipse shape, as explained with reference to FIG. 1. This is done in an attempt to make the projection of the mixing part 20 on a plane parallel to the central strip portions 15 a circle. Namely, since the mixing part 20 has a circular shape, the mixing module (see FIG. 5) has a circular shape after assembly, as viewed from the front side of the drawing. Therefore, the mixing module 30 can properly be disposed in a piping having a circular section.

In a case in which a plurality of mixing modules 30 are disposed in a piping, it is preferred that the mixing modules 30 be serially disposed in a close contact such that each of the mixing modules 30 is angularly rotated by 90° from the adjacent one.

In this case, the tail portions 24A and 25A (shown in FIG. 5) among plural tail portions are cut-off at the working lines for bending of the central strip portion 15. This makes the setting of an adjacent mixing modules 30 easier.

Figure 6:
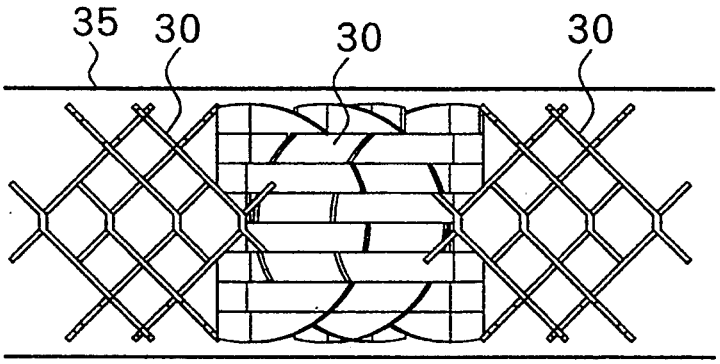
FIG. 6 is a sectional view of the static mixing module in an assembled state.

It is preferred that at least one of contacting portions between adjacent two mixing modules 30 be welded before the plurality of mixing modules 30 are set in the piping 35, as shown in FIG. 6. This prevents the mixing modules 30 from vibrating due to fluid pressure.

Figure 7:
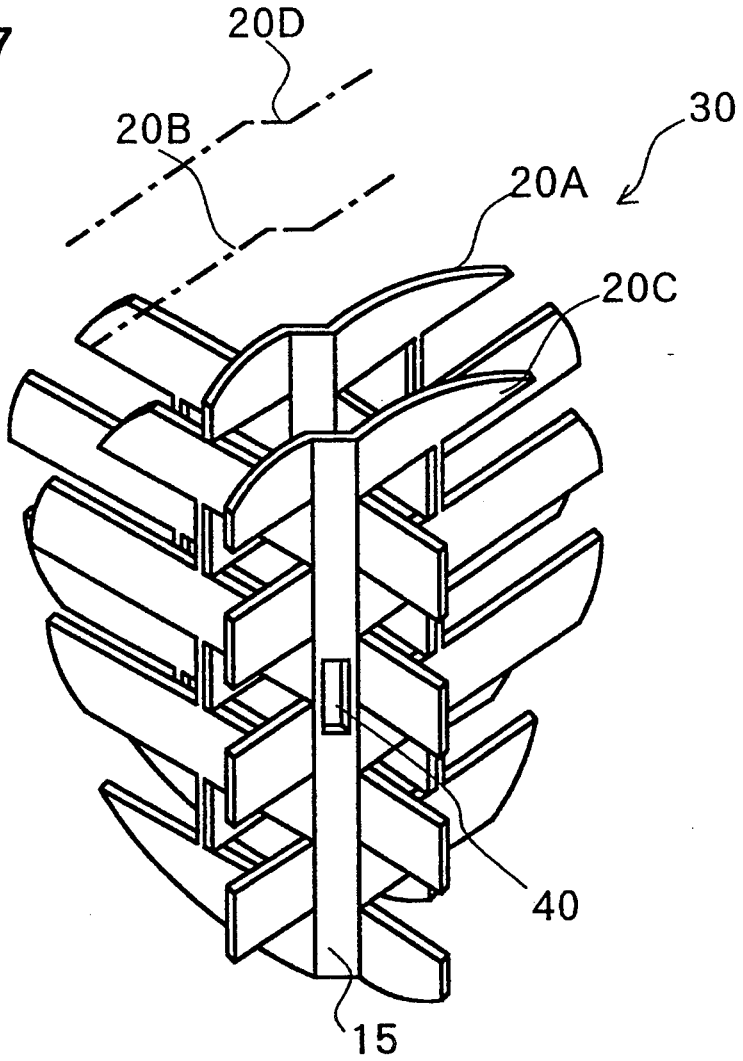
FIG. 7 is a perspective view showing another embodiment of the static mixing module.

The plurality of mixing modules 30 may be set in the piping 35 without welding. In this case, as shown in FIG. 7, a rectangular through hole 40 is formed in each of the central strip portions 15 which are opposed to one another, and a not-rotated shaft (not illustrated) having a rectangular cross section corresponding to the shape of the holes 40 is passed through the holes 40. This fixed shaft prevents the rotation of the mixing modules 30. In this case, it is preferred that the mixing modules 30 located at both axial ends be fixed with being pressed inwardly.

The size of the mixing modules 30 may be freely changed by changing the lengths and widths of the wing portions 22 and 23 and the tail portions 24 and 25.

In the above embodiment, the each of the tail portions 24 and 25 is bent by 45° as shown in FIG. 3. Therefore, the mixing modules 30 can be arranged in order to form square grids. In a case in which it is not necessary to form the square grids, the tail portions 24, 25 are not necessarily required to be bent, and may be bent by a smaller angle. Further, the tail portions 24, 25 may be twisted. Moreover, the tail portions 24, 25 may be omitted.

Figure 8:
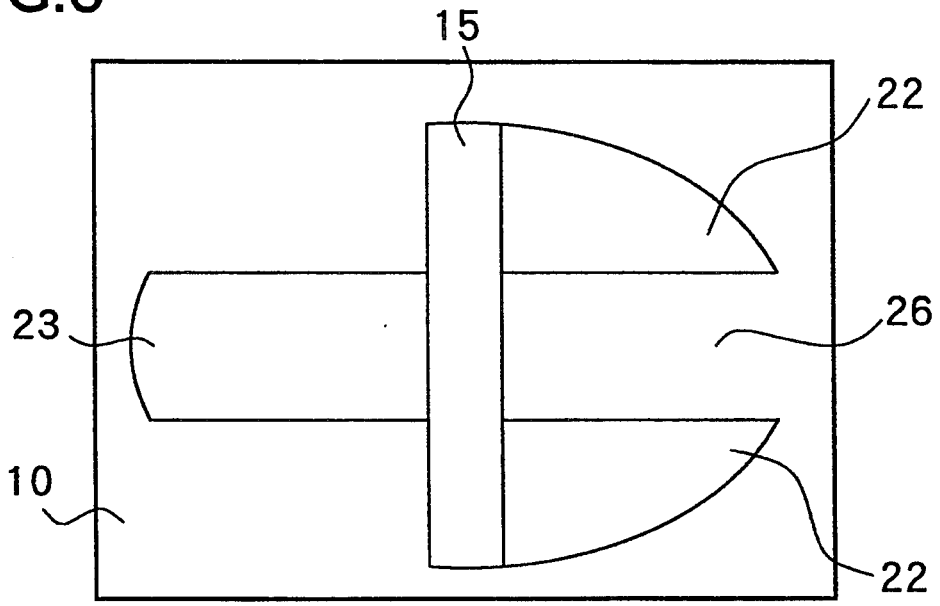
FIG. 8 is a plane view showing working lines for press and working lines for bending.
Figure 9:
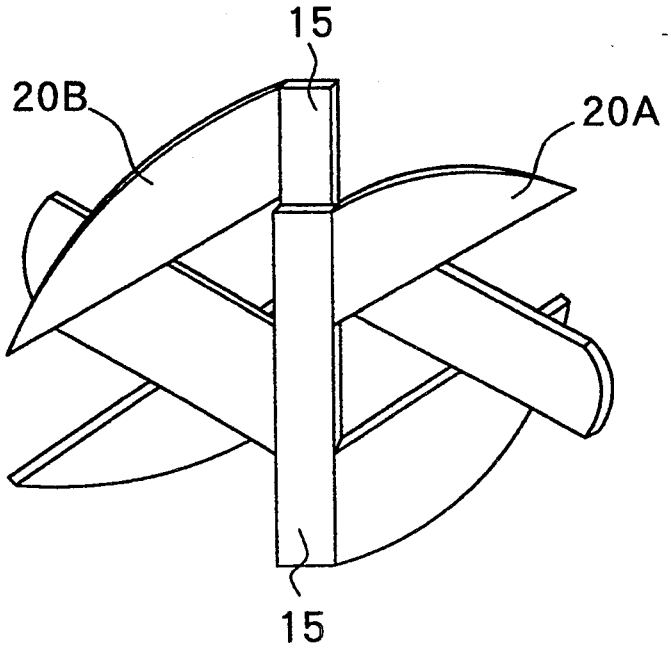
FIG. 9 is a perspective view of a mixing part.
Figure 10:
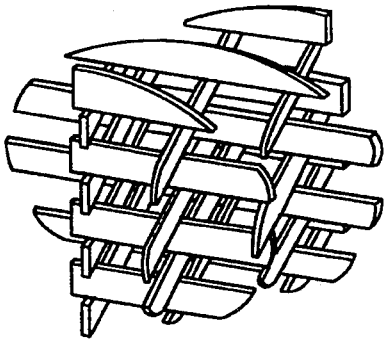
FIG.10 PRIOR ART
FIG. 10 (Prior Art) is a perspective view of a conventional static mixing module.
Figure 11A:
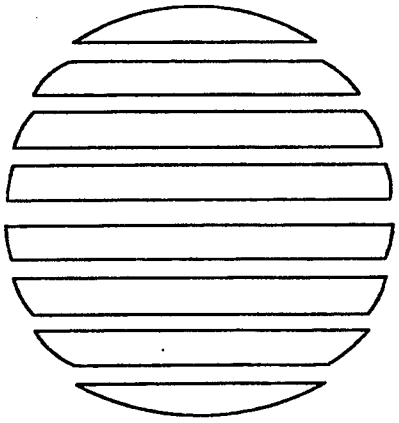
FIG.11A PRIOR ART
FIGS. 11A and 11B (Prior Art) are explanatory charts for the conventional products.
Figure 11B:
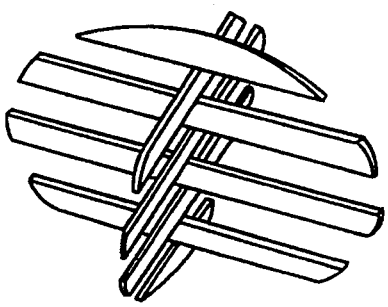
FIG.11B PRIOR ART
Figure 12A:
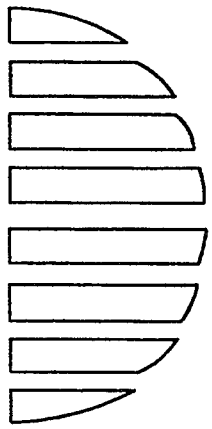
FIG.12A PRIOR ART
FIGS. 12A and 12B (Prior Art) are explanatory charts for the conventional products.
Figure 12B:
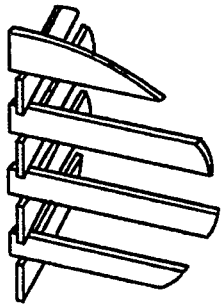
FIG.12B PRIOR ART
Figure 13A:
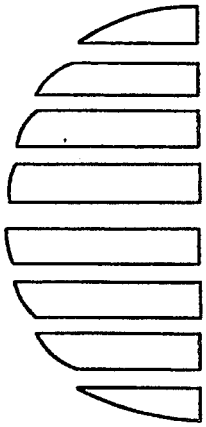
FIG.13A PRIOR ART
FIGS. 13A and 13B (Prior Art) are explanatory charts for the conventional products.
Figure 13B:
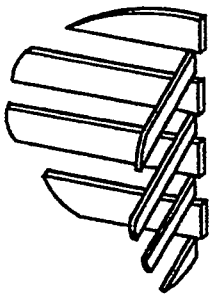
FIG.13B PRIOR ART
Figure 14:
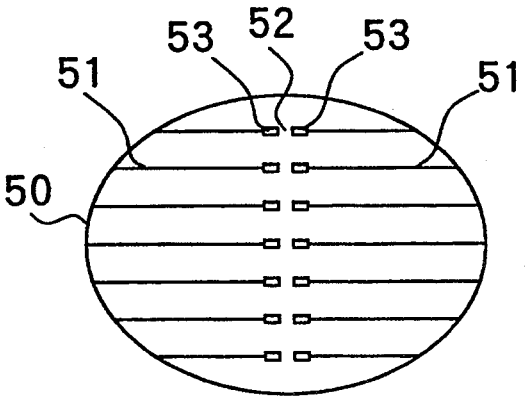
FIG.14 PRIOR ART
FIG. 14 (Prior Art) is an explanatory chart for the conventional products.
Figure 15:
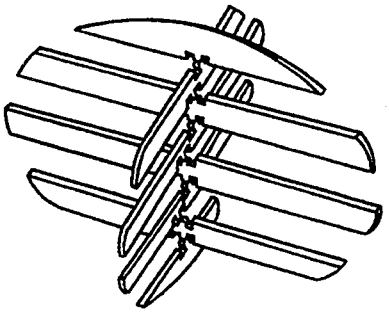
FIG.15 PRIOR ART
FIG. 15 (Prior Art) is an explanatory chart for the conventional products.
Figure 16A:
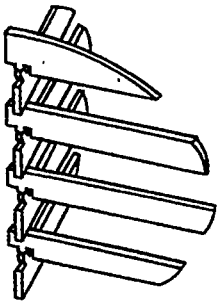
FIG.16A PRIOR ART
FIGS. 16A and 16B (Prior Art) are explanatory charts for the conventional products.
Figure 16B:
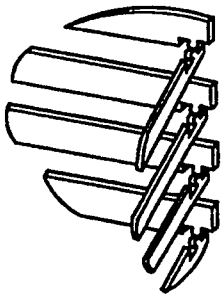
FIG.16B PRIOR ART

Although the above-described embodiment shows an example in which the static mixing module is disposed in a pipe having a relatively large diameter, it is preferred to employ the method shown FIGS. 8 through 10 for manufacturing a static mixing module which is to be disposed in a pipe having a relatively small diameter (inside diameter: about 10 to 50 mm).

Namely, a stainless steel plate 10 is punched by press-working along the solid line shown in FIG. 8 to leave a central strip portion 15 along the minor axis of the ellipse, and wing portions extending along the major axis of the ellipse and having a predetermined width. On the right side of the central strip portion 15, a wing portion 22, a cut-out portion 26 and a wing portion 22 are formed in this order from the top as viewed in the drawing. On the left side of the central strip portion 15, a wing portion 23 is formed at a position opposite to the cut-out portion 26 located on the right side.

Next, bending is carried out at working lines for bending which define both sides of the central strip portion 15 to manufacture a mixing part shown in FIG. 9. In FIG. 9, two mixing parts 20A and 20B are shown. A static mixing module 30 is manufactured by assembling these mixing parts 20A and 20B.

Further, another pair of more mixing parts having the same configuration may be combined therewith.

Although the present invention was explained with reference to the above embodiments, the present invention can be applied to static mixing modules which are suitable to be disposed in pipings having larger diameters.

What is claimed is:

1. A static mixing module comprising at least one pair of mixing parts, wherein a plate is punched out in an elliptical shape such that a central strip portion extending along the minor axis of the ellipse is left, wing portion having a predetermined width and extending in a direction perpendicular to said central strip portion are left on both sides of said central strip portion, and a cut-out portion is formed between adjacent two wing portions located on at least one side of said central strip portion; and the wing portions on both sides are bent at working lines for bending which define the both sides of said central strip portion by an angle of about 45° in the same direction with respect to said central strip portion so as to prepare each of said mixing parts such that it substantially has a circular outer shape, and wherein the wing portions of said pair of mixing parts are faced each other and the central strip portions are arranged in parallel to each other with their both ends being aligned, and the wing portions are then inserted into the corresponding cut-out portions.

2. A static mixing module comprising at least one pair of mixing parts, wherein a plate is punched out to have an elliptical shape such that a central strip portion extending along the minor axis of the ellipse is left, wing portions each having a predetermined width and extending in a direction perpendicular to said central strip portion alternately are left on both side of said central strip portion and tail portions shorter than said wing portions are left at positions opposite to said wing portions with respect to said central strip portion, a cut-out portion is formed at the end of each tail portion, thereby a support portion being formed between each tail portion and each cut-out portion; and the wing portions on both sides are bent at working lines for bending which define the both side of said central strip portion by an angle of about 45° in the same direction with respect to said central strip portion, and the tail portions on both sides are bent by an angle of about 45° in a direction opposite to the direction in which said wing portions are bent so as to prepare each of said mixing parts such that it substantially has a circular outer shape, and wherein the wing portions of a pair of said mixing parts are faced each other and the central strip portions are arranged in parallel to each other with their both ends being aligned, and the wing portions are then inserted into the corresponding cut-out portions until said wing portions contact said support portions.

3. A static mixing module according to claim 2, further comprising a second pair of mixing parts which are attached to both outer sides of said first pair of mixing parts.

4. A static mixing module according to claim 3, wherein said second pair of mixing parts are attached to both outer sides of said first pair of mixing parts such that the wing portions of said second pair of mixing parts are inserted into open ends of the cut-out portions of said first pair of mixing parts.

5. A static mixing module according to claim 4 wherein each of said support portions connects two of said wing portions.

6. A static mixing module according to claim 3 wherein each of said support portions connects two of said wing portions.

7. A static mixing module according to claim 2 wherein each of said support portions connects two of said wing portions.

8. A static mixing module comprising two interleaved mixing parts, each of said mixing parts comprising:

a flat central strip;

plural first wing portions extending angularly from a first side of said central strip;

plural second wing portions extending angularly from a second side of said central strip;

first tail portions extending angularly from said second side of said central strip opposite one of said first wing portions and having a length less than said opposite one of said first wing portions; and second tail portions extending angularly from said first side of said central strip opposite one of said second wing portions and having a length less than said opposite one of said second wing portions;

wherein said central strips of said two interleaved mixing parts are parallel and said first wing portions of one of said mixing parts are interleaved with said second wing portions of the other of said mixing parts.

9. The static mixing module of claim 8 further comprising support portions connecting adjacent ones of said first wing portions.

10. The static mixing module of claim 9 further comprising support portions connecting adjacent ones of said second wing portions.

11. The static mixing module of claim 8 wherein said first wing portions and said second wing portions extend in the same direction relative to said central strip.

12. The static mixing module of claim 11 wherein said first wing portions and said second wing portions extend from said central strip at about 45°.

13. The static mixing module of claim 11 wherein said first tail portions and said second tail portions extend in the same direction relative to said central strip and in the opposite direction from said first wing portions and said second wing portions relative to said central strip.

14. The static mixing module of claim 13 wherein said first tail portions and said second tail portions extend from said central strip at about 45°.

* * * * *